United States Patent [19]

Shevchenko et al.

[11] 4,095,447

[45] Jun. 20, 1978

[54] METHOD AND ROLLING MILL FOR CONTINUOUS TUBE ROLLING

[76] Inventors: Alexandr Andreevich Shevchenko, ploschad Oktyabrskaya, 5, kv. 13; Gennady Ivanovich Gulyaev, ulitsa Sevastopolskaya, 52; Igor Alexandrovich Chekmarev, prospekt Gagarina, 2, kv. 9; Petr Alexeevich Loskutov, prospekt K. Marxa, 82, kv. 71; Vitaly Nikolaevich Cherny, ulitsa Karuna, 47, kv. 4; Valentin Nikolaevich Danchenko, prospekt K. Marxa, 55, kv. 30, all of Dnepropetrovsk; Valery Georgievich Balakin, ulitsa Malakhitovaya, 14, kv. 18, Moscow; Evgeny Stepanovich Bondarenko, ulitsa Pervomaiskaya, 24, kv. 6; Vladimir Petrovich Bednyakov, prospekt Lenina, 28, kv. 109, both of Elektrostal Moskovskoi oblasti; Vladimir Mikhailovich Bokov, ulitsa Sovetskaya, 41, kv. 46, Noginsk Moskovskoi oblasti; Fedor Terentievich Vinogradov, ulitsa Pushkina, 4a, kv. 13, Elektrostal Moskovskoi oblasti, all of U.S.S.R.

[21] Appl. No.: 733,370

[22] Filed: Oct. 18, 1976

[51] Int. Cl.[2] ..... B21B 17/04

[52] U.S. Cl. ..... 72/208; 72/235

[58] Field of Search ..... 72/208, 209, 234, 235, 72/96, 370

[56] References Cited

U.S. PATENT DOCUMENTS

| | | | |
|---|---|---|---|
| 274,964 | 4/1883 | Ostrander | 72/209 |
| 988,569 | 4/1911 | Harkness | 72/209 |
| 3,566,655 | 3/1971 | Sholten et al. | 72/209 |
| 3,813,911 | 6/1974 | Biblghhaus | 72/214 |

*Primary Examiner*—Milton S. Mehr

*Attorney, Agent, or Firm*—Lackenbach, Lilling & Siegel

[57] ABSTRACT

The invention relates to the manufacture of seamless tubes by the method of tube rolling. According to the method of the present invention a hollow blank is deformed with regard to its wall thickness, the deformation being alternated at least twice with a reduction of the diameter of the blank by means of a mandrel with alternating groups of grooves for deformation and groups for reduction. The mandrel diameter at the portions corresponding to the groups of reduction grooves is smaller than the mandrel diameter at the preceding portions corresponding to the groups of grooves designed for deformation of the hollow blank to change the wall thickness thereof. During the continuous rolling, this enables subsequent levelling out of bulges at the tube ends in grooves on the mandrel during the deformation of the blank wall. As a result, the range of rolled tubes is considerably enlarged with an increased production of small-diameter thick-walled tubes and large-diameter thin-walled tubes without bulged ends.

9 Claims, 14 Drawing Figures

METHOD AND ROLLING MILL FOR CONTINUOUS TUBE ROLLING

The invention relates to the rolling and, more particularly, to a method and rolling mill for continuous tube rolling.

Known in the art is a method for the manufacture of seamless tubes from a hollow thick-walled blank, by deformation according to the wall thickness on a mandrel with subsequent reduction. Known in the art is an apparatus for effecting this method including a continuous mandrel mill and a sinking rolling mill which are arranged sufficiently adjacent to each other. The rolling in the continuous rolling mill is effected on a long mandrel in a number of series-mounted stands with rolls having passes forming grooves having a size decreasing in the direction of rolling. The space between the vertex of the groove and the mandrel decreases from the first to the ultimate stand of the rolling mill. During the rolling the mandrel is moved by means of a special arrangement at a speed which is considerably lower than the speed of entrance of the blank into the rolling mill. The tube is rolled in a sinking rolling mill without a mandrel.

In making finished a tube from a hollow thick-walled blank on a continuous rolling mill, a preset deformation of the blank according to the wall thickness and diameter thereof should be effected. However, the above-described rolling mill is designed for effecting deformation mainly aimed at reducing the wall thickness of the hollow blank. Thus, the reduction of the outside diameter is insignificant, and it is mainly due to the reduction of the wall thickness. As a result, the tubes are manufactured over a limited diameter range.

In order to obtain a wide range of diameters and wall thicknesses as of the tubes, the tubes are rolled on a sinking rolling mill after a continuous tube rolling mill.

Rolling of a hollow thick-walled blank on a continuous rolling mill on a movable mandrel requires the minimum possible distance of the continuous rolling mill from the sinking rolling mill. In this case intermediate heating of the tube prior to the reduction is excluded.

The tubes are rolled on the sinking rolling mill without a mandrel in series-mounted stands with rolls having oval grooves. Such a shape of the grooves provides for the best finish of the outer surface of the tubes as compared with other shapes of the grooves. However, employment of oval grooves causes nonuniformity of deformation of the tubes along the perimeter, and, hence, results in the appearance of cross-sectional nonuniformity of the wall thickness.

Thus the initial wall thickness of a tube is increased substantially in any case (except for the case of rolling of heavy tubes with a wall thickness-to-diameter ratio of about 0.3), if no longitudinal tensile stress is applied. In order to reduce the cross-sectional nonuniformity of wall thickness, as well as to increase the overall deformation and decrease the initial wall thickness, the rolling in a sinking rolling mill is effected under longitudinal tensile stressing of the tube, that is with tensioning. This is achieved by an appropriate differentiation of rotational speeds of the rolls in adjacent stands. However, with an individual reduction under tensioning, there is a negative consequence of the method residing in the appearance of a substantial longitudinal nonuniformity of wall thickness. Thus an increase in the wall thickness at the tube ends materially exceeds permissible deviations. The formation of the longitudinal nonuniformity of wall thickness at the ends is inevitably associated with the fact that the end portions of a tube are reduced under considerably lower longitudinal tensile stress than the main (intermediate) portion of the tube. This is due to the interaction of stands through the tube being rolled.

It is known that the value of longitudinal tensile stress in a given section of a tube is defined by the number of stands contributing to the deformation at a given moment. The end portions of the tube are rolled under conditions corresponding to a gradual increase or decrease of the number of stands contributing to the deformation of the tube at the same time. Thus, the tension value also fluctuates, which results in the appearance of excessive longitudinal nonuniformity of wall thickness at the end portions of the tube. Accordingly, the ends of the tubes in which the wall thickness exceeds permissible deviations should be cut off thus resulting in increased metal consumption. In some cases the amount of the losses is so large that the reduction of tubes under tensioning becomes economically disadvantageous.

Therefore, the available amount of overall deformation by the diameter limits the range of tubes rolled on continuous rolling mills, and the formation of bulged ends of the tubes after the reduction results in an increased metal consumption.

It is an object of the invention to provide a method of continuous tube rolling and a tube rolling mill for effecting the method which enable a required deformation of a hollow thick-walled blank according to the wall thickness and diameter thereof without intermediate heating and with a minimum rate of metal consumption.

With this and other objects view, in a method of continuous tube rolling is presented wherein the method comprises the step of deformation of a hollow blank wall on a mandrel with subsequent reduction, according to the invention, deformation of the hollow blank wall being alternated at least twice with a reduction thereof by means of a mandrel with alternating groups of grooves for deformation and for reduction, the mandrel diameter at the portions corresponding to the grooves for reduction being smaller than the mandrel diameter at the preceding portions thereof corresponding to the grooves for deformation of the blank wall.

For effecting the method according to the invention, there is provided a continuous tube rolling mill comprising groups of stands with rolls having passes forming grooves and a mandrel installed therein for deformation of the wall, and groups of stands with rolls having passes forming grooves for reduction of the blank. According to the invention, in this rolling mill, the groups of stands for deformation of the hollow blank wall are alternated at least twice with the groups of stands for reduction, and the mandrel is installed in the grooves in a spaced relationship therewith in all groups of stands of the rolling mill, the diameter of the mandrel at the portions corresponding to the groups of stands for reduction being smaller than the mandrel diameter at the preceding portions corresponding to the groups of stands for deformation of the hollow blank wall.

During continuous tube rolling in accordance with the invention, bulges formed at the tube ends during the reduction under tensioning are subsequently levelled out in grooves on the mandrel during the deformation of the blank wall. As a result, the range of rolled tubes is substantially enlarged in the increased production of small-diameter thick-walled tubes and large-diameter thin-walled tubes. In addition, the wall thickness at the ends of the tubes manufactured in accordance with the invention is within the tolerances.

According to the invention, the mandrel length is smaller than the length of the rolling mill by an amount equal to the length of the ultimate group of stands for reduction. This enables high accuracy of manufacture of the tubes as regards the diameter.

In accordance with one embodiment of the invention, the space between the mandrel and the vertex of the groove in each stand at the portions corresponding to the groups of stands for reduction increases in the direction of rolling.

In accordance with another embodiment of the invention, the space between the mandrel and the vertex of the groove in each stand at the portions corresponding to the groups of stands for reduction remains unchanged.

According to the invention, the portions of the mandrel corresponding to the groups of stands for reduction may have their generatrix line extending in parallel with or inclinded with respect to the axis of rolling. In addition, these portions of the mandrel may be stepped.

The invention is also characterized in that the mandrel is provided with an axial bore at the portions corresponding to the groups of stands for reduction and a plurality of radial passages uniformly spaced along the periphery communicating with the axial bore for feeding lubricant to the inner surface of the blank being rolled.

Therefore, the method of tube rolling according to the invention using the rolling mill according to the invention, provides for the required deformation of a thick-walled blank according to the wall thickness and diameter thereof. Thus a wide range of tubes and a high quality of tubes is ensured without intermediate heating of the blank and with a minimum rate of metal consumption.

The use of the continuous tube rolling mill according to the invention incorporated in a tube-rolling plant give an opportunity to reduce production areas, cost of equipment, capital investments and power cost, while increasing the productivity and bettering the quality of the product.

The invention will now be described in detail with reference to specific embodiments of the method and rolling mill illustrated in the accompanying drawings, in which.

The term "deformation" means the thickness of the walls of the pipe is being reduced. The term "reduction" means the diameter of the pipe is being reduced.

Figure 1:
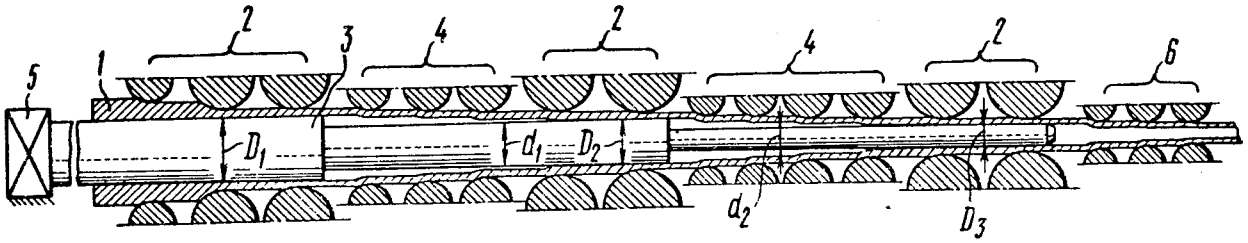
FIG. 1 is a longitudinal cross sectional view of a device, embodying the method of continuous tube rolling according to the invention.

In accordance with the method of the invention, the tubes are rolled in the following manner: a hollow blank 1 (FIG. 1) is deformed, with regard to its wall thickness in groups of grooves 2 on a mandrel 3 and reduced in groups of grooves 4. The hollow blank 1 is deformed with regard to its wall thickness is the groups of grooves 2 alternately at least twice with the reduction of the diameter of the hollow blank 1 in the groups of grooves 4.

The mandrel 3 is installed substantially in all groups of grooves and is moved by means of any appropriate holding mechanism 5 having a hydraulic cylinder provided with a piston rod bearing against the mandrel shank. In addition, at the portions corresponding to the groups of grooves 4 for reduction the diameters $d_1$, $d_2$. . . $d_n$ of the mandrel 3 are smaller than the diameters $D_1$, $D_2 \ldots D_n$ thereof at the preceding portions corresponding to the groups of grooves 2 for deformation of the hollow blank 1, to change the wall thickness thereof, so that $D_1 > d_1$; $D_2 > d_2$; . . . $D_n > d_n$.

In order to provide for a high accuracy of the tubes as regards the diameter, the process of rolling is preferably completed in a group 6 of grooves for reduction which does not have a mandrel, and for that purpose the length of the mandrel 3 is smaller than the length of the rolling mill by an amount equal to the length of the group 6 of grooves for reduction.

The method for continuous tube rolling according to the invention is effected in a rolling mill 7 (FIG. 2) incorporated in a tube rolling plant having the following components of a conventional type: a furnace 8 for heating solid blanks, a rolling mill 9 for obtaining the hollow thick-walled blank 1, a device 10 for feeding the hollow thick-walled blank to a trough 11 having rollers 12 designed for feeding the blank 1 to the rolling mill 7, a trough 13 for installation of the mandrel 3 having rollers 14 for movement of the mandrel 3 toward the rolling mill 7, the mechanism 5 for holding the mandrel 3, and a roller table 15 for transporting finished tubes 16 to a cooler 17.

The continuous tube rolling mill 7 comprises groups of stands A of conventional type (FIGS. 3–5) with rolls having passes forming the grooves 2 for deformation of the hollow blank 1 with regard to its well thickness, and groups B of stands with rolls having passes forming the grooves 4 for reduction of the blank 1. The groups of stands A are mounted in the rolling mill 7 alternately at least twice with the groups of stands B. The rolling mill terminates in the group of grooves 6 for reduction.

The mandrel 3 passes through all stands A and B. As mentioned above, the length of the mandrel 3 is smaller than the length of the rolling mill by an amount equal to the length of the ultimate group of stands, that is to the length of the groups of grooves 6 for reduction. The mandrel 3 is mounted in a spaced relationship with the grooves 2 and 4 of the stands A and B, respectively, and the diameters $d_1$, $d_2 \ldots d_n$ thereof at the portions corresponding to the groups of stands B for reduction are smaller than the mandrel diameters $D_1$, $D_2$, . . . $D_n$ at the preceding portions corresponding to the groups of stands A.

Figure 9:
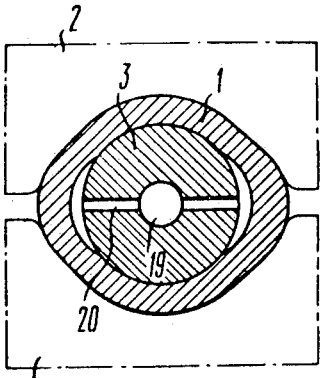
FIG. 9 is a cross sectional view taken along the line IX—IX in FIG. 6.
Figure 10:
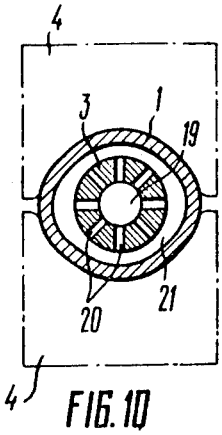
FIG. 10 is a cross sectional view taken along the line X—X in FIG. 6.
Figure 11:
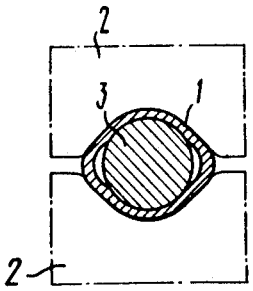
FIG. 11 is a cross sectional view taken along the line XI—XI in FIG. 6.
Figure 12:
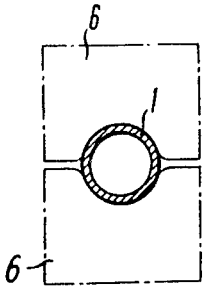
FIG. 12 is a cross sectional view taken along the line XII—XII in FIG. 6.
Figure 13:
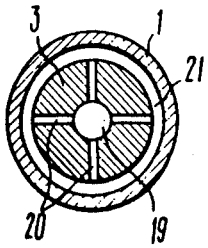
FIG. 13 is a cross sectional view taken along the line XIII—XIII in FIG. 7.
Figure 14:
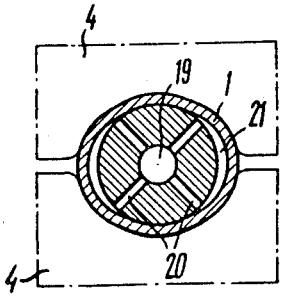
FIG. 14 is a cross sectional view taken along the line XIV—XIV in FIG. 7.

The shank of the mandrel 3 is connected to the mechanism 5 and is provided with a pipe 18 for feeding lubricant to the inner surface of the blank 1 being rolled through an axial bore 19 of the mandrel 3 (FIGS. 6, 7, 8, 9, 10, 11, 12, 13, 14) and radial passages 20 equally spaced over the periphery of the mandrel at the portions corresponding to the groups of stands B and communicating with the axial bore 19 as shown in FIGS. 10, 13, 14.

In the groups of stands A (FIGS. 6, 7, 8) for deformation of the wall of the hollow blank 1 on the mandrel 3, lubricant is fed only to the zones in which the blank 1 is spaced apart from the mandrel 3 as shown in FIG. 9. Thus only a part of the inner surface of the blank 1 being rolled is lubricated.

Figure 6:
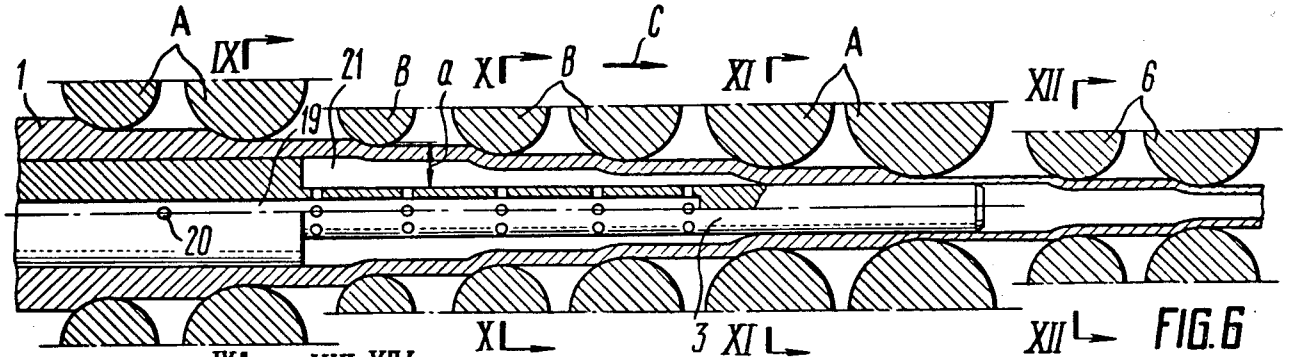
FIGS. 6, 7 and 8 show various embodiments of the mandrel.
Figure 7:
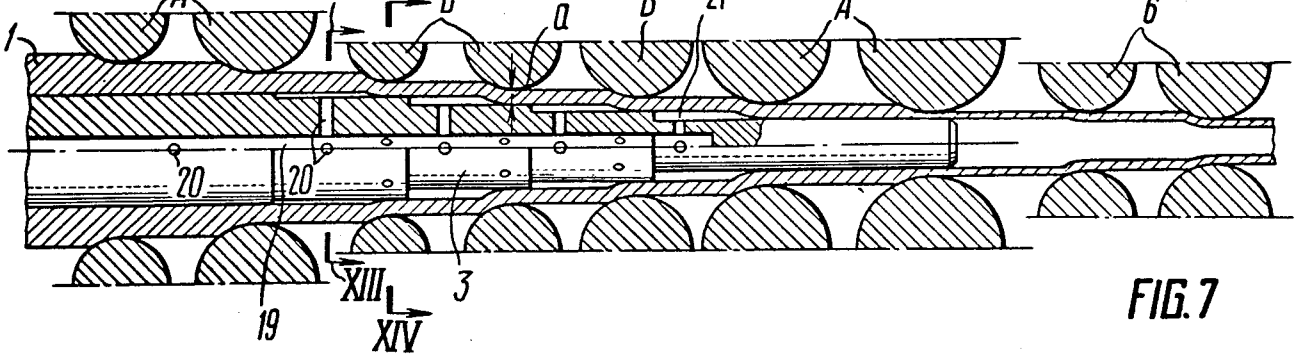
Figure 8:
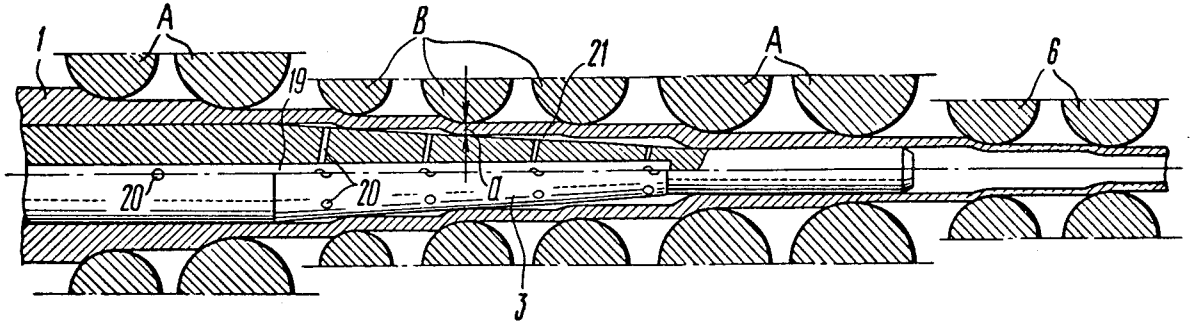

In the groups of stands B, in which the reduction of the diameter of the blank 1 takes place (FIGS. 6, 7, 8), the mandrel 3 is installed with a space "*a*" with respect to the vertex of the groove 4 of each stand B, the amount of space either decreasing in the direction of rolling as shown by arrow C in FIG. 6, or remaining unchanged as shown in FIGS. 7 and 8. Accordingly, the generatrix line of the mandrel extends either in parallel with (FIGS. 6, 7) or in an inclined position to (FIG. 8) the axis of rolling.

Therefore, at the portions corresponding to the groups of stands B, the mandrel 3 may have cylindrical (FIG. 6), stepped (FIG. 7) of tapered (FIG. 8) shape.

There is an annular space 21 provided between the surface of the mandrel 3 and the inner surface of the blank being rolled in the groups of stands B (FIGS. 6, 7, 8, 10, 13). This space enables the arrangement of the radial passages 20 for feeding lubricant in equally spaced relationship with one another over the periphery of the mandrel 3 so as to ensure the supply of lubricant to the entire surface of the blank 1 being rolled at the portions corresponding to the groups of stands B for reduction.

Continuous rolling of tubes on the rolling mill according to the invention is effected in the following manner.

Figure 2:
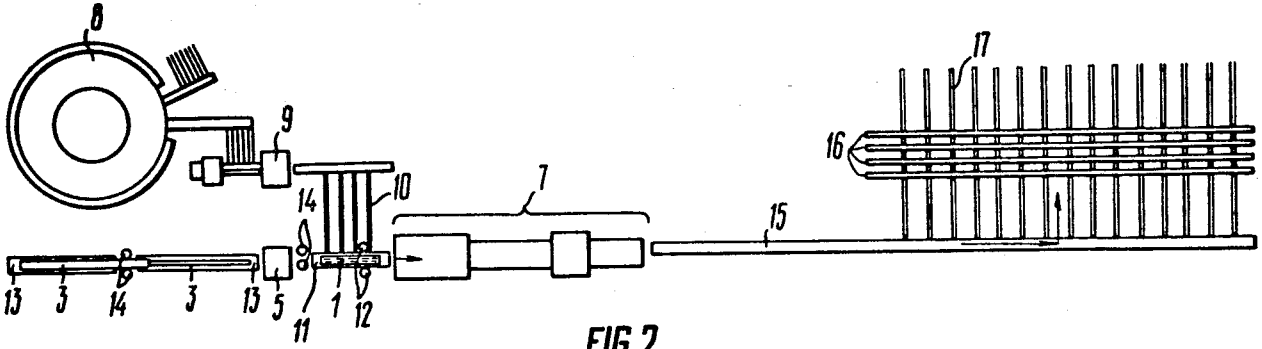
FIG. 2 shows the arrangement of the continuous tube rolling mill incorporated in a tube rolling plant.
Figures 3, 4, 5:
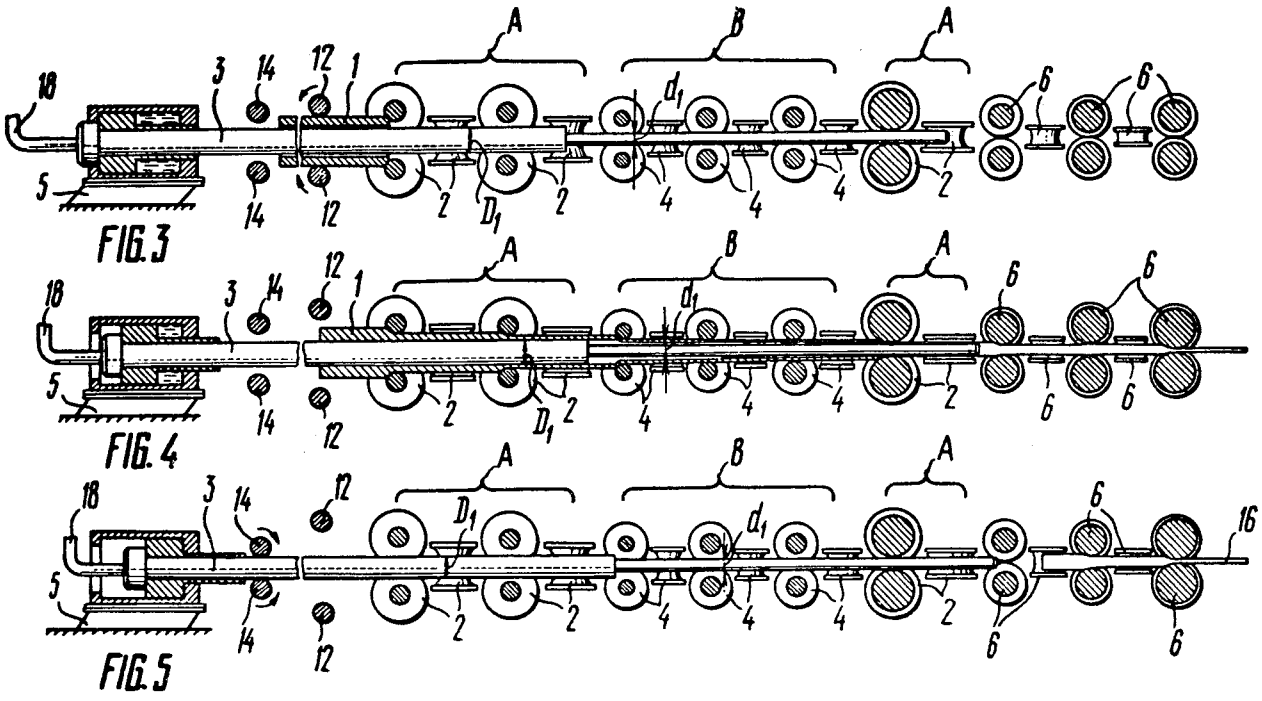
FIGS. 3, 4 and 5 show relative positions of the mandrel and tube at different moments of the rolling process in the continuous tube rolling mill.

A hollow thick-walled blank is fed to the input end of the rolling mill at the trough 11 (FIG. 2). At the same time, the long mandrel 3 is also fed to the trough 13. Then the mandrel 3 is introduced into the blank 1 by means of the rollers 14, and further into the continuous rolling mill 7 in such a manner that the forward end of the mandrel 3 should reach the core zone of deformation of the ultimate stand A deforming the wall of the tube (FIGS. 3, 4 and 5). Thus the shank of the mandrel 3 is connected to the mechanism 5 for holding the mandrel. At that moment the rollers 12 feed the blank 1 into the rolling mill 7, and the rolling begins.

During the rolling, an axial force transmitted from the blank 1 to the mandrel 3 is taken up by the mechanism 5 for holding the mandrel which imparts to mandrel 3 the movement at a speed which is substantially lower than the speed of entrance of the blank 1 into the rolling mill 7, at a distance not exceeding two times the distance between the axes of the adjacent stands A deforming the wall of the blank 1.

The rolling of the blank 1 is effected by alternating the deformation of the blank 1 with regard to the thickness of the wall thereof in the groups of grooves 2 of the stands A with the reduction of the diameter of the blank in the groups of grooves 4 (FIG. 1) of the stands B.

When the trailing end of the tube 16 being rolled approaches the sizing group of stands 6 (FIG. 5), the force holding the mandrel is removed, and the mandrel 3 is withdrawn by the rollers 14 from the rolling mill 7 into the initial position in the trough 13 (FIG. 2). The finished tube 16 is fed along the delivery roller table 15 to the cooler 17 and further for finishing.

The holding mechanism 5 for holding the mandrel is put into the initial position and the cycle is repeated.

Where a long-term use mandrel is employed, the mandrel is not withdrawn from the rolling mill to the input end thereof after the rolling of every blank, but is only transferred to the initial position corresponding to the beginning of the rolling. By this method the blank is fed into the rolling mill axially.

We claim:

1. A method of continuous tube rolling comprising the steps of: deforming the wall thickness of a hollow blank in groups of grooves on a mandrel; reducing the diameter of said blank after said deformation; alternating at least twice said deformation of the wall thickness of the blank with said reduction of the diameter of the blank; installing said mandrel substantially in all groups of grooves, the diameter of said mandrel at the portions corresponding to the groups of grooves for reduction being smaller than the mandrel diameter at the preceding portions corresponding to the groups of grooves for deformation of the blank according to the wall thickness thereof.

2. A continuous tube rolling mill comprising: groups of stands for deformation of the wall thickness of a hollow blank provided with rolls having grooves; groups of stands for reduction of the diameter of the hollow blank provided with rolls having grooves, said groups of stands for deformation of the wall thickness of the hollow blank being mounted alternately at least twice with said groups of stands for reduction of the diameter of the hollow blank; and mandrel mounted in the grooves of said stands in a spaced relationship therewith, the mandrel extending substantially through all said groups of stands and effecting, in combination with the grooves of the groups of stands, said deformation of the wall thickness of the hollow blank, the diameter of said mandrel at the portions corresponding to the groups of stands for reduction being smaller than the mandrel diameter of the preceding portions corresponding to the groups of stands for deformation of the wall thickness of the hollow blank.

3. A continuous tube rolling mill comprising: groups of stands for deformation of the wall thickness of a hollow blank provided with rolls having grooves; groups of stands for reduction of the diameter of the hollow blank provided with rolls having grooves, said groups of stands for deformation of the wall thickness of the hollow blank being mounted alternately at least twice with said groups of stands for reduction of the diameter of the hollow blank; a mandrel mounted in the grooves of said stands in a spaced relationship therewith, the mandrel extending substantially through all said groups of stands and effecting, in combination with the grooves of the groups of stands, said deformation of the wall thickness of the hollow blank, the diameter of said mandrel at the portions corresponding to the groups of stands for reduction being smaller than the mandrel diameter of the preceding portions corresponding to the groups of stands for deformation of the wall thickness of the hollow blank, the length of the mandrel being smaller than the length of the rolling mill by an amount equal to the length of an ultimate group of stands for reduction.

4. A continuous tube rolling mill comprising: groups of stands for deformation of the wall thickness of a hollow blank provided with rolls having grooves; groups of stands for reduction of the diameter of the hollow blank provided with rolls having grooves, said groups of stands for deformation of the wall thickness of the hollow blank being mounted alternately at least twice with said groups of stands for reduction of the diameter of the hollow blank; a mandrel mounted in the grooves of said stands in a spaced relationship therewith, the mandrel extending substantially through all said groups of stands and effecting, in combination with the grooves of the groups of stands, said deformation of the wall thickness of the hollow blank, the diameter of said mandrel at the portions corresponding to the groups of stands for reduction being smaller than the mandrel diameter of the preceding portions corresponding to the groups of stands for deformation of the wall thickness of the hollow blank, a space between the mandrel and a vertex of the groove of each stand at the portions corresponding to the groups of stands for reduction decreasing in the direction of rolling.

5. A rolling mill according to claim 4, wherein a generatrix line of the mandrel at the portions corresponding to the groups of stands for reduction extends at an angle with respect to an axis of rolling.

6. A continuous tube rolling mill comprising: groups of stands for deformation of the wall thickness of a hollow blank provided with rolls having grooves; groups of stands for reduction of the diameter of the hollow blank provided with rolls having grooves, said groups of stands for deformation of the wall thickness of the hollow blank being mounted alternately at least twice with said groups of stands for reduction of the diameter of the hollow blank; a mandrel mounted in the grooves of said stands in a spaced relationship therewith, the mandrel extending substantially through all said groups of stands and effecting, in combination with the grooves of the groups of stands, said deformation of the wall thickness of the hollow blank, the diameter of said mandrel at the portions corresponding to the groups of stands for reduction being smaller than the mandrel diameter of the preceding portions corresponding to the groups of stands for deformation of the wall thickness of the hollow blank, a space between the mandrel and a vertex of the groove of each stand at the portions corresponding to the groups of stands for reduction remaining constant.

7. A rolling mill according to claim 6, wherein a generatrix line of the mandrel at the portions corresponding to the groups of stands for reduction extends parallel to an axis of rolling.

8. A rolling mill according to claim 7, wherein portions of the mandrel corresponding to the groups of stands for reduction are stepped.

9. A continuous tube rolling mill comprising: groups of stands for deformation of the wall thickness of a hollow blank provided with rolls having grooves; groups of stands for reduction of the diameter of the hollow blank provided with rolls having grooves, said groups of stands for deformation of the wall thickness of the hollow blank being mounted alternately at least twice with said groups of stands for reduction of the diameter of the hollow blank; a mandrel mounted in the grooves of said stands in a spaced relationship therewith, the mandrel extending substantially through all said groups of stands and effecting, in combination with the grooves of the groups of stands, said deformation of the wall thickness of the hollow blank, the diameter of said mandrel at the portions corresponding to the groups of stands for reduction being smaller than the mandrel diameter of the preceding portions corresponding to the groups of stands for deformation of the wall thickness of the hollow blank, the mandrel being provided with an axial bore and with a plurality of radial passages equally spaced over the periphery of the mandrel at the portions corresponding to the groups of stands for reduction, said radial passages communicating with the axial bore for feeding lubricant to the inner surface of the blank being rolled.

* * * * *